United States Patent [19]

Forney et al.

[11] 4,244,706

[45] Jan. 13, 1981

[54] PROCESS FOR GASIFYING CARBONACEOUS MATERIAL FROM A RECYCLED CONDENSATE SLURRY

[75] Inventors: Albert J. Forney, Coraopolis; William P. Haynes, Pittsburgh, both of Pa.

[73] Assignee: The United States of America as represented by the United States Department of Energy, Washington, D.C.

[21] Appl. No.: 74,352

[22] Filed: Sep. 10, 1979

[51] Int. Cl.[3] ..... C10J 3/54

[52] U.S. Cl. ..... 48/202; 48/206; 48/DIG. 7; 201/4; 252/373

[58] Field of Search ..... 48/197 R, 202, 203, 48/206, 210, DIG. 7; 252/373; 201/4, 31, 35, 38, 39

[56] References Cited

U.S. PATENT DOCUMENTS

| | | | |
|---|---|---|---|
| 2,591,595 | 4/1952 | Ogorzaly | 48/206 |
| 2,595,234 | 5/1952 | Eastman | 48/202 |
| 3,607,157 | 7/1971 | Schlinger et al. | 48/206 |
| 3,957,460 | 5/1976 | Lee | 48/197 R |
| 4,017,272 | 4/1977 | Aniver et al. | 48/197 R |
| 4,067,700 | 1/1978 | Switzer | 201/4 |

FOREIGN PATENT DOCUMENTS 2002025 2/1979 United Kingdom ..... 48/DIG. 7

OTHER PUBLICATIONS

Synthane Gasifier Effluent Streams, McMichael et al., 3/1977, PERC/RI-77/4.

*Primary Examiner*—Peter F. Kratz

*Attorney, Agent, or Firm*—James E. Denny; Frank H. Jackson; Hugh W. Glenn

[57] ABSTRACT

Coal or other carbonaceous material is gasified by reaction with steam and oxygen in a manner to minimize the problems of effluent water stream disposal. The condensate water from the product gas is recycled to slurry the coal feed and the amount of additional water or steam added for cooling or heating is minimized and preferably kept to a level of about that required to react with the carbonaceous material in the gasification reaction. The gasification is performed in a pressurized fluidized bed with the coal fed in a water slurry and preheated or vaporized by indirect heat exchange contact with product gas and recycled steam. The carbonaceous material is conveyed in a gas-solid mixture from bottom to top of the pressurized fluidized bed gasifier with the solids removed from the product gas and recycled steam in a supported moving bed filter of the resulting carbonaceous char. Steam is condensed from the product gas and the condensate recycled to form a slurry with the feed coal carbonaceous particles.

13 Claims, 1 Drawing Figure

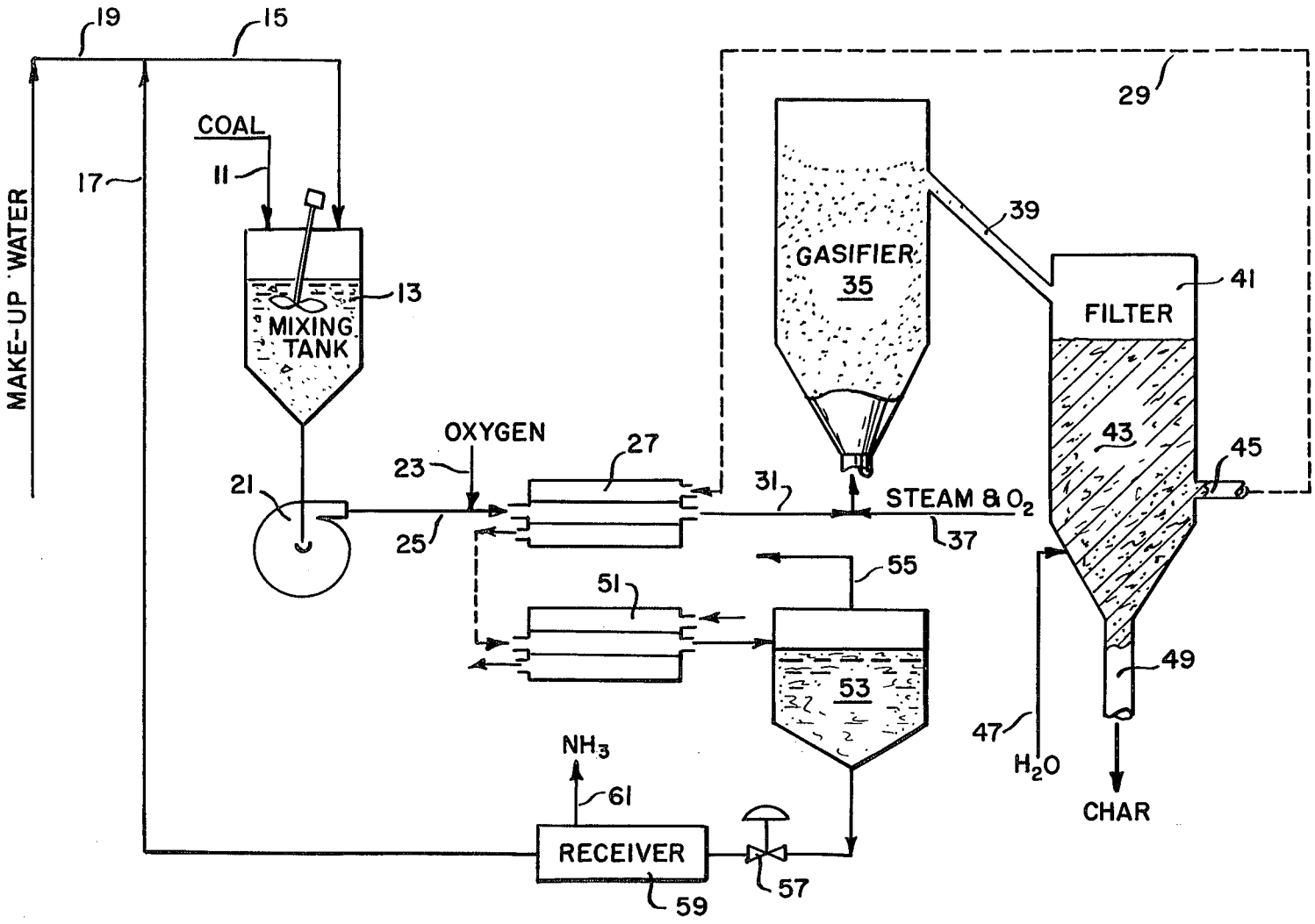
FILTER
41
45
43
49
CHAR
$H_2O$
47
29
39
GASIFIER
35
STEAM & $O_2$
37
55
53
31
57
27
51
RECEIVER
59
$NH_3$
61
OXYGEN
23
25
13
MIXING TANK
21
COAL
11
15
19
17
MAKE-UP WATER

PROCESS FOR GASIFYING CARBONACEOUS MATERIAL FROM A RECYCLED CONDENSATE SLURRY

CONTRACTUAL ORIGIN OF THE INVENTION

The invention described herein was made in the course of, or under, a contract with the UNITED STATES DEPARTMENT OF ENERGY.

BACKGROUND OF THE INVENTION

The present invention relates to methods for the gasification of coal or other carbonaceous material. Gasification occurs through pyrolysis as well as reaction of carbon with oxygen and steam to form hydrogen and the carbon oxide gases. The materials contemplated for use include the various types of coal, e.g. lignite and bituminous, as well as various other solid carbonaceous materials.

Previous coal gasification methods such as the SYNTHANE Process of the Pittsburgh Energy Technology Center in Bruceton, Pennsylvania carry with them the problem of eliminating or minimizing environmental pollutants found in the effluent streams from the processes. One of such streams is the condensate from the product gas which not only contains fine particulate char but significant quantities of ammonia, aromatics and traces of sulfur-bearing compounds. This condensate water is primarily unused steam fed to the gasifier. The condensate can include an immiscible mixture of a water phase containing dissolved organics and an oil phase containing condensed tars that are a mixture of heavy aromatics with boiling points above that of water. One of the difficult problems with the SYNTHANE Process and other coal gasification processes is the treatment or disposal of this effluent stream.

PRIOR ART STATEMENT

The following patents relate to but do not disclose the process of the applicants' invention as described and claimed herein.

U.S. Pat. No. 3,957,460 to Lee, "Oxidation of Coal-Water Slurry Feed to Hydrogasifier", 1976. This patent describes a process in which coal is slurried with fresh water subjected to partial oxidation by injection of high-pressure oxygen and introduced into the top portion of a hydrogasifier in direct contact with the hot product gases. Impurities within the coal slurry would appear to have an excellent opportunity of being entrained within the product gases.

U.S. Pat. No. 3,966,633 to Friedman, "Waste Water Processing", 1976. This patent describes a process in which waste water formed in the gasification of coal is flashed into a stream of superheated steam and fed into a gasifier where the organic impurities are decomposed. It does not teach the slurrying of the coal feed with the condensate water prior to introduction into the gasifier.

U.S. Pat. No. 4,018,654 to Johnson et al., "Pretreatment of Coal During Transport", 1977, discloses a process for decaking finely divided coal during its transport within an oxygen-containing gas through a heated pipe. The gas can include inert components such as steam, carbon dioxide and nitrogen.

None of the above patents teaches a process in which condensate water is recycled to slurry carbonaceous feed material and subsequently vaporized to provide reaction steam and fluidizing gas flow for the gasification process.

SUMMARY OF THE INVENTION

In view of the above, it is an object of the present invention to provide a gasification process in which effluent liquids are minimized or eliminated.

It is a further object to provide a gasification process in which impurities within the carbonaceous material that may have catalytic activity are permitted to recycle into direct contact with the solid carbonaceous feed material.

It is also an object to provide a gasification process in which aromatic materials ordinarily lost to the waste water are recycled to the gasifier.

In accordance with the present invention, a process for gasifying solid carbonaceous material by its reaction with $H_2O$ and $O_2$ is provided. The carbonaceous material within a water slurry is pumped from a first to a second pressure at which a hot oxygen-containing gas is injected at a temperature substantially above that of the slurry. The slurry is heated to a first temperature at which the carbonaceous material and oxygen begin to combust and the slurry water is vaporized to form steam. The resulting gas-solids mixture is passed from bottom to top through a fluidized bed to combust an additional portion of the carbonaceous material and increase the temperature to a second temperature at which gasification occurs by pyrolysis and by reaction of carbon with steam to form CO and $H_2$. The gas-solids mixture is withdrawn from the top of the fluidized bed and the solids permitted to settle into a downwardly moving but supported bed for filtering the gas flow. The gas flow is cooled to condense its contained steam and the resulting condensate recycled to form a slurry with entering carbonaceous material.

In more specific aspects of the present invention, the gas flow filtered through the downwardly moving bed is subsequently passed in indirect heat exchange with the feed slurry to recuperate a portion of the process heat. The lower portion of the moving bed is cooled with $H_2O$ to a temperature below that at which rapid oxidation occurs prior to removing the carbonaceous char from the process. The $H_2O$ added as steam for heating and reacting with the carbonaceous material and as liquid water for cooling the char and slurrying the feed is preferably held to below that required to react with all of the carbonaceous material fed into the process.

BRIEF DESCRIPTION OF THE DRAWING

The present invention is illustrated in the accompanying FIGURE which is a flow diagram of a gasification process for carbonaceous material.

DETAILED DESCRIPTION OF THE PREFERRED EMBODIMENT

In the FIGURE, a coal gasification system is illustrated. In one manner of performing the process of the present invention, coal or other carbonaceous material 11 is fed into a mixing tank or other vessel 13 along with a flow of water 15. Although coal of up to one-quarter inch particle size can be used, it is preferably comminuted to a size such that 70% by weight passes through 200 U.S. Standard Mesh Sieve with 20 mesh maximum size. The water comprises recycled condensate 17 and startup or makeup water 19 whenever it is needed. As an example, about one part by weight water including recycle is added at 15 for each part by weight coal. If desired, a catalyst of, for instance, alkaline earth metal, alkali metal or a transition metal in suitable form can be included in the slurry.

The slurry is formed at about atmospheric pressure to avoid use of lock hoppers in feeding the coal. A pump or other suitable means 21 increases the slurry pressure to that suitable for entering the gasifier, for instance within a range of about 200 -1000 psi. Although it is not critical, a typical pressure of about 400 -600 psi can be employed.

A flow of preheated oxygen-containing gas 23 is injected into the slurry flow 25 at a point prior to the gasification step. The oxygen-containing gas 23 can be oxygen, air, oxygen-air mixtures, oxygen-steam mixtures, air-steam mixtures or mixtures of oxygen, air and steam as well as mixtures including other inert constituents with oxygen. The steam can be added as one manner of heating the oxygen-containing gas to an elevated temperature of, for instance, about 600°-1200° F. As an example, a mixture advantageously employed uses about 1 weight part oxygen to 4 weight parts steam at a temperature of about 1000° F.

The slurry of carbonaceous material with oxygen-containing gas is further preheated to a temperature at which the slurry water vaporizes and the carbonaceous material begins to combust in the oxygen-containing gas. This temperature depends on the pressure and characteristics of the carbonaceous material as well as other factors, but typically a first process temperature of about 500°-800° F. is used for this pretreatment of the carbonaceous material. In the case of lignite and bituminous coal, this partial oxidation in vapor phase reduces the tendency of the coal to agglomerate in the gasifier.

The preheating of the coal slurry 25 is performed at least in part by indirect heat exchange contact within heat exchanger 27. Heat is transferred from a flow of filtered gas 29 from the gasifier. By advantageously using the heat in this stream 29 for preheating the feed slurry 25, less cooling capacity is subsequently required for removing condensate from the gas flow 29.

The resulting gas-solids mixture 31 is fed into gasifier 35 which is operated as a fluidized bed. Additional steam and oxygen-containing gas 37 are injected into the lower part of the gasifier 35 to ensure adequate reactants for the gasification reaction. The flow of vaporized water from the slurry and the added steam and oxygen-containing gases are at sufficient velocity to fluidize the particles of carbonaceous material.

Further combustion of the carbonaceous material within gasifier 35 increases the temperature of the gas-solids in the fluidized bed to a sufficient level for the water-gas reaction to occur. In this reaction, carbon reacts with steam in a 1 to 1 mole ratio that is about 12 weight parts of reacting carbon with about 18 weight parts steam to form carbon monoxide and hydrogen gas in equal molar quantities. A second process temperature within the range of about 1500° F. to 1800° F. is suitable for carrying out this reaction. At these elevated temperatures, pyrolysis of the carbonaceous material also occurs to release hydrocarbons of about 1-4 carbon atoms and other volatiles contained within the carbonaceous material.

The mixture of gases and reacted carbonaceous material or char is withdrawn from the top portion of the gasifier fluidized bed at 39 and passed to a filter bed vessel 41. In vessel 41 the solid char particles are permitted to settle to form a supported but downwardly moving filter bed 43. The gas portion of the mixture is filtered through the upper portion of bed 43 before being withdrawn at 45 towards the lower portion of the bed. The moving bed of char is cooled to a temperature within the range of about 500°-800° F. in the lower bed portion by the injection of $H_2O$ at 47 either as steam, liquid water or a mixture of these phases. The cooling of the char generates or provides additional steam that is removed with the filtered gases at 45. The char containing unreacted carbon is withdrawn at 49 for use as a fuel or further processing.

The filtered gases at temperatures of about 1500°-1700° F. are recycled through conduit 29 into one side of heat exchanger 27 for indirect heat exchange into the slurry of carbonaceous material. This step provides at least a portion of the heat needed to elevate the slurry temperature to 500°-800° F. and thereby begins cooling and condensing the steam within the gases.

The gases are further cooled to, for instance, about 200°-300° F. within cooler 51 to condense out most of the water collected as contaminated condensate in receiver 53. Product gas containing carbon monoxide, hydrogen, hydrocarbons and other carbonaceous material is withdrawn at 55 for further processing. For example, desulfurization and other purification, enrichment in hydrogen by the shift reaction, or methanation may be performed.

The impure condensate water within receiver 53 is expanded through valve 57 to the pressure at which the slurry of carbonaceous material is formed, i.e. about one atmosphere. Ammonia possibly along with hydrogen sulfide and other dissolved gases are released at 61. The amount of these dissolved gases removed can be regulated by the temperature of the condensate liquid before expansion to atmospheric pressure. The contaminated condensate remaining after this flashing step is collected in receiver 59 and pumped through conduit 17 into the slurry tank 13 for mixing with the coal feed.

Through use of the present process, the organic materials including phenols and other aromatics carried over into the condensate can be recycled along with the feed coal into the gasifier where they are decomposed to more volatile and less noxious materials at the high gasifier temperatures. Likewise, fine particles of char and water-insoluble tars are recycled so that these materials need not constitute a waste disposal problem in effluent liquids.

The preferable manner of carrying out the present method is to add only enough $H_2O$ as water and as steam at the various inlets to react on a 1 to 1 mole basis with the carbon available for the water-gas reaction within gasifier 35. The $H_2O$ inlets referred to are the water inlet 19, the oxygen-containing gas inlet 23, the steam-oxygen-containing gas inlet at 37 and the coolant $H_2O$ at 47.

A substantial portion of the carbon reacts with oxygen to form carbon dioxide or carbon monoxide with the production of heat for driving the gasification process. In addition, unreacted carbon is removed as char at 49 and some carbon undergoes pyrolysis in the gasifier. Consequently, a one to one mole ratio (18 to 12 weight ratio) of water to carbon in the feed will provide much more than that needed to react with the carbon in the gasification reaction. It is estimated that approximately 25 to 50 percent of the carbonaceous material must be combusted in order to provide the heat of reaction to drive the gasification reaction and that another 10-15 percent of the carbon leaves the gasifier unreacted. Therefore about 1 part by weight $H_2O$ for each 1 to 2 parts by weight carbon is an appropriate amount to add as water or steam at points 19, 23, 37 and 47 of the process. Such an amount will permit the elimination of a waste water effluent stream.

One other important aspect of the invention is the recycling of various materials such as boron, silicon, halogens, alkali metals and alkaline earth metals that may have a catalytic effect in the gasification reaction. The following table shows the concentration of these various elements in a bituminous coal fed to the SYNTHANE prototype gasifier and the concentration of these same materials found in the condensate water. These data in parts per million are given in PERC/TPR-75/1, "Trace Element and Major Component Balances around the Synthane PDU Gasifier", 1975, page 14. Neither the results nor this report contemplate the recycle of the condensate water.

TABLE I

| Element | PPM in Coal | PPM in $H_2O$ |
|---|---|---|
| Ca | >10,000 | 2 |
| B | 86 | 82 |
| Cl | 93 | 190 |
| F | 280 | 32 |
| Na | 1900 | 5.4 |
| K | >10,000 | 0.31 |
| Si | >10,000 | 6.6 |

It is therefore seen from this table that materials such as boron and the fluorides could enjoy a substantial buildup in concentration within the feed coal slurry. Some lesser but significant concentration buildup of the other elements on recycle of the contaminated condensate liquid also may occur. These materials have an opportunity to permeate into the solid carbonaceous material from the liquid phase of the slurry and achieve catalytic activity within the subsequent gasifier reaction.

In comparative gasifications at about 1500° F. and 300 psig over about three hour periods, the average yield in standard cubic centimeters of gas per gram of carbon input and the reactivity in mass of carbon gasified per mass carbon input for coal treated with Synthane plant condensate and coal treated with distilled water are given in Table II.

TABLE II

| | $H_2$ | $CH_4$ | CO | Total | Reactivity |
|---|---|---|---|---|---|
| Condensate | 621 | 276 | 108 | 1005 | 0.467 |
| Distilled water | 562 | 169 | 97 | 827 | 0.459 |

Table II thus illustrates increased conversion that may be attributable to the catalytic activity of trace elements in the condensate. This activity should increase as the trace elements build up in concentrations as a result of the condensate recycle aspect of the present process.

It will therefore be seen that the present process provides a method of gasifying coal or other carbonaceous material in which the effluent water stream with undesirable tars, aromatics and char particles can be minimized or eliminated by recycle of the condensate stream into a slurry with the feed coal. This not only reduces the waste processing burden of the plant but recovers valuable raw materials and adds various elements of possible catalytic value into intimate liquid-solid contact to diffuse into the carbonaceous feed material at increased concentrations. This process also provides a filtering technique in which residual char is used as a filter for the product gas prior to withdrawal.

Although the present invention has been described in terms of particular materials and process conditions, it will be understood that various changes can be made within the scope of the following claims.

The embodiments of the invention in which an exclusive property or privilege is claimed are defined as follows:

1. A process for gasifying solid carbonaceous material by reaction with $H_2O$ and $O_2$ comprising:

forming a water slurry of carbonaceous material at a first pressure and pumping said slurry to a second and higher pressure;

injecting oxygen-containing gas at a temperature above that of said slurry into the slurry at said second pressure;

heating the slurry to a first temperature to combust a portion of said carbonaceous material and vaporize the water of the slurry to form a gas-solid mixture;

passing said gas-solid mixture from bottom to top through a fluidized bed to combust an additional portion of said carbonaceous material and thereby heat to a second temperature at which gasification occurs by pyrolysis and reaction of carbon with steam to form CO and $H_2$;

withdrawing gas-solid mixture from the top portion of said fluidized bed and allowing the solids to settle to form a downwardly moving bed of supported solids;

filtering the gas from said gas-solids mixture through the upper portion of said downwardly moving bed of supported solids; and condensing steam from the filtered gas stream and recycling the resulting condensate to form said water slurry with said carbonaceous material.

2. The process of claim 1 wherein the lower portion of said downwardly moving supported bed of solids is contacted with $H_2O$ to cool said solids to within the range of 500°-800° F.

3. The process of claim 2 wherein liquid water is added to cool the lower portion of said moving bed.

4. The process of claim 1 wherein said filtered gas flow is passed in indirect heat exchange with said slurry to cool said gas and to provide a portion of the heat needed to heat and vaporize said slurry.

5. The process of claim 1 wherein the total amount of $H_2O$ added other than said recycled $H_2O$ for slurrying said carbonaceous material, heating said slurry, reacting with said carbonaceous material and cooling said moving bed of supported particles is less than that required to gasify all of said carbonaceous material.

6. The process of claim 5 wherein said added $H_2O$ is in a weight ratio of one part $H_2O$ to 1 to 2 parts carbon in the feed carbonaceous material.

7. The process of claim 1 wherein said first pressure is about 1 atmosphere pressure and said second pressure is about 200 -1000 psi.

8. The process of claim 1 wherein said oxygen-containing gas is selected from the group of gases consisting of air, air enriched in oxygen, oxygen, steam-air mixtures, steam-oxygen mixtures, and steam-air-oxygen mixtures.

9. The process of claim 8 wherein said oxygen-containing gas is injected into said slurry at a temperature of about 1000° F.

10. The process of claim 8 wherein said oxygen-containing gas includes an oxygen to steam weight ratio of about 1:4.

11. The process of claim 1 wherein said first temperature is about 500°–800° F. and said second temperature is about 1500°–1800° F.

12. The process of claim 1 wherein said carbonaceous material is coal of particle size sufficiently small that 70% by weight thereof passes through 200 U.S. standard mesh sieve with 20 mesh maximum particle size.

13. The process of claim 1 wherein said condensate pressure is reduced from said second pressure to said first pressure to flash off ammonia prior to slurrying the condensate with said carbonaceous material.

* * * * *